US010539127B2

(12) United States Patent
Lee et al.

(10) Patent No.: US 10,539,127 B2
(45) Date of Patent: Jan. 21, 2020

(54) LINEAR COMPRESSOR

(71) Applicant: LG ELECTRONICS INC., Seoul (KR)

(72) Inventors: Sangmin Lee, Seoul (KR); Sunghyun Ki, Seoul (KR); Junghae Kim, Seoul (KR); Jihyun Yoon, Seoul (KR); Jaeyong Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 294 days.

(21) Appl. No.: 15/584,338

(22) Filed: May 2, 2017

(65) Prior Publication Data

US 2017/0321681 A1 Nov. 9, 2017

(30) Foreign Application Priority Data

May 3, 2016 (KR) ..... 10-2016-0054889

(51) Int. Cl.
*F04B 39/12* (2006.01)
*F04B 39/00* (2006.01)
*F04B 35/04* (2006.01)

(52) U.S. Cl.
CPC ..... *F04B 39/121* (2013.01); *F04B 35/045* (2013.01); *F04B 39/0027* (2013.01); *F04B 39/0044* (2013.01); *F04B 39/0072* (2013.01); *F04B 39/12* (2013.01)

(58) Field of Classification Search
CPC .... F04B 39/121; F04B 39/0044; F04B 39/12; F04B 39/0027; F04B 39/0072; F04B 39/0005; F04B 35/045
See application file for complete search history.

(56) References Cited

U.S. PATENT DOCUMENTS 2,291,346 A * 7/1942 Robinson ..... F04D 29/126 417/363
4,416,594 A * 11/1983 Ichikawa ..... F04B 39/127 248/606
5,649,812 A * 7/1997 Schoenmeyr ..... F04B 43/0054 417/363

(Continued)

FOREIGN PATENT DOCUMENTS

CN 203835658 9/2014
CN 106979137 7/2017

(Continued)

OTHER PUBLICATIONS

Russian Office Action dated May 10, 2018.

(Continued)

*Primary Examiner* — Devon C Kramer
*Assistant Examiner* — David N Brandt
(74) *Attorney, Agent, or Firm* — Ked & Associates LLP

(57) ABSTRACT

The linear compressor is provided that may include a shell having first and second ends open, a first shell cover that covers a first end of the shell, a second shell that covers a second end of the shell, a compressor body accommodated in the shell to compress a refrigerant, a first support that supports a first end of the compressor body within the shell and coupled to the first shell cover in a state of being spaced apart from the shell, and a second support that supports a second end of the compressor body and fixed to the shell.

10 Claims, 15 Drawing Sheets

(56) References Cited

U.S. PATENT DOCUMENTS

| | | | | |
|---|---|---|---|---|
| 6,273,688 | B1 * | 8/2001 | Kawahara | F04B 35/045 417/363 |
| 6,361,293 | B1 * | 3/2002 | Harper | F04C 23/008 417/312 |
| 10,280,914 | B2 * | 5/2019 | Han | F04B 35/04 |
| 2010/0172769 | A1 | 7/2010 | Lilie et al. | |
| 2013/0058811 | A1 * | 3/2013 | Hong | F04B 35/045 417/417 |
| 2015/0184651 | A1 * | 7/2015 | Ki | F04B 17/03 417/349 |
| 2017/0016436 | A1 * | 1/2017 | Ki | F04B 35/045 |

FOREIGN PATENT DOCUMENTS

| | | |
|---|---|---|
| CN | 107304759 | 10/2017 |
| EP | 2 963 301 | 1/2016 |
| EP | 3 196 460 | 7/2017 |
| IN | 675/KOL/2014 | 2/2015 |
| JP | 2011-094569 | 5/2011 |
| KR | 10-2016-0001055 | 1/2016 |
| KR | 10-2016-0009306 | 1/2016 |
| RU | 2 529 926 | 10/2014 |
| RU | 2 535 412 | 12/2014 |
| WO | WO 2015/099306 | 7/2015 |

OTHER PUBLICATIONS

European Search Report dated Sep. 21, 2017 issued in Application No. 17167093.8.
Chinese Office Action dated Aug. 28, 2018 issued in Application No. 201710287747.3 (English Translation Attached).
Indian Office Action dated Aug. 27, 2019.

* cited by examiner

LINEAR COMPRESSOR

CROSS-REFERENCE TO RELATED APPLICATION(S)

The present application claims the benefits of priority to Korean Patent Application No. 10-2016-0054889 filed in Korea on May 3, 2016, which is herein incorporated by reference in its entirety.

BACKGROUND

1. Field

A linear compressor is disclosed herein.

2. Background

Cooling systems are systems in which a refrigerant circulates to generate cool air. In such a cooling system processes of compressing, condensing, expanding, and evaporating the refrigerant are repeatedly performed. The cooling system includes a compressor, a condenser, an expansion device, and an evaporator. Also, the cooling system may be installed or provided in a home appliance including a refrigerator or an air conditioner.

In general, compressors are machines that receive power from a power generation device, such as an electric motor or a turbine, to compress air, a refrigerant, or various gaseous working fluids, thereby increasing a pressure and a temperature. The compressors are being widely used in home appliances or industrial fields.

Such a compressor is largely classified into a reciprocating compressor, a scroll compressor and a rotary compressor. In recent years, development of a linear compressor belonging to one kind of reciprocating compressor has been actively carried out. The linear compressor may be directly connected to a dive motor, in which a piston is linearly reciprocated, to improve compression efficiency without mechanical loss due to movement conversion and have a simple structure.

In general, the linear compressor suctions a gaseous refrigerant while a piston is moved to linearly reciprocate within a cylinder by a linear motor and then compresses the suctioned refrigerant at a high-temperature and a high-pressure to discharge the compressed refrigerant. A linear compressor and a refrigerator including the same are disclosed in Korean Patent Publication No. 10-2016-0009306, published on Jan. 26, 2016, which is hereby incorporated by reference.

The linear compressor includes a suction part a discharge part, a compressor casing, a compressor body, and a body support. The body support is configured to support the compressor body within the compressor casing and disposed on each of both ends of the compressor body.

The body support includes a plate spring. The plate spring is mounted in a direction perpendicular to an axial direction of the compressor body. In this case, the plate spring may have high transverse rigidity (rigidity with respect to a direction that extends perpendicular to the axial direction of the compressor body) and low longitudinal rigidity (rigidity with respect to the axial direction of the compressor body).

However, according to the related art document, as the plate spring is directly fixed to the compressor casing, vibration of the compressor body is transmitted to the compressor casing by the plate spring. Thus, the compressor casing may be vibrated to generate noise due to the vibration of the compressor casing.

Also, the plate spring of the compressor disclosed in the prior art document may be fixed only if covers are coupled in a state of being inserted into support member mounting parts disposed on both ends of a compressor casing. Thus, as the plate spring is not fixed in position before the covers are coupled to the compressor casing, work convenience when the compressor is assembled may be deteriorated.

BRIEF DESCRIPTION OF THE DRAWINGS

Embodiments will be described in detail with reference to the following drawings in which like reference numerals refer to like elements, and wherein.

DETAILED DESCRIPTION

Figure 1:
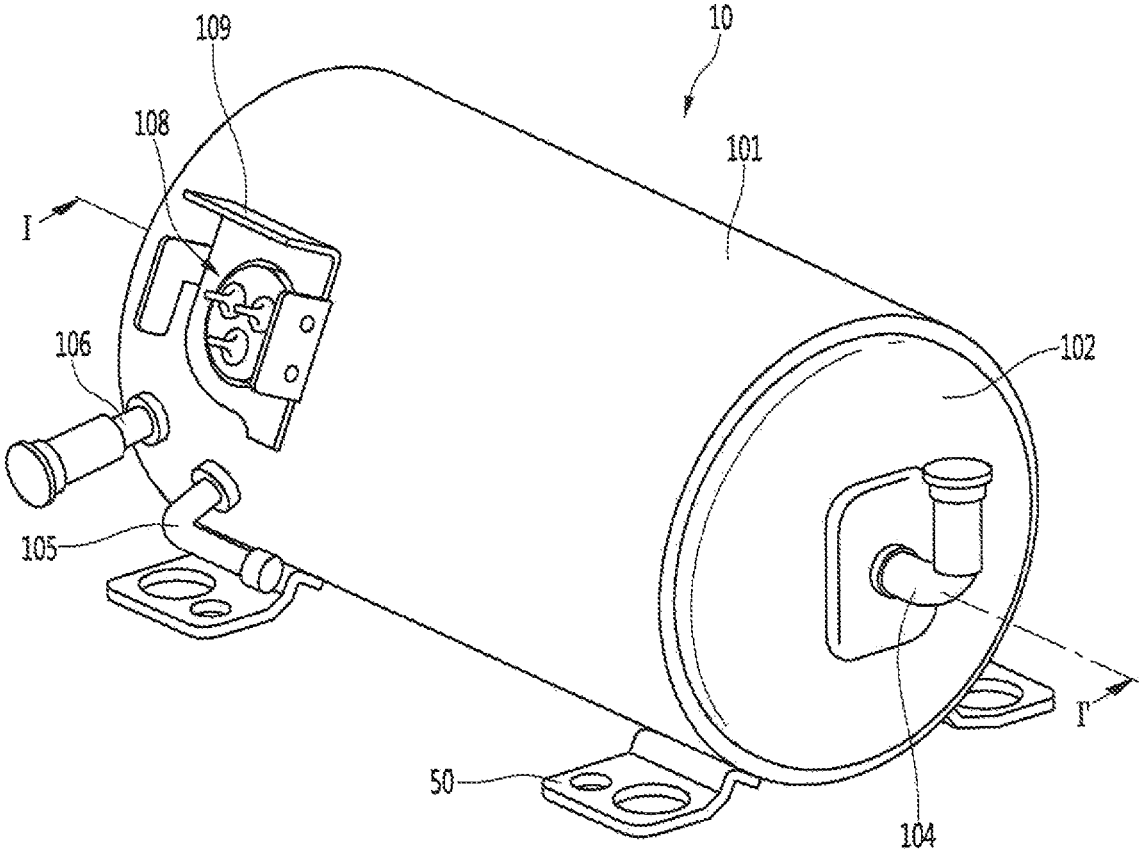
FIG. 1 is a perspective view illustrating an outer appearance of a linear compressor according to an embodiment.

Hereinafter, embodiments will be described in detail with reference to the accompanying drawings. Where possible, like reference numerals have been used to indicate like elements, and repetitive disclosure has been omitted.

Figure 2:
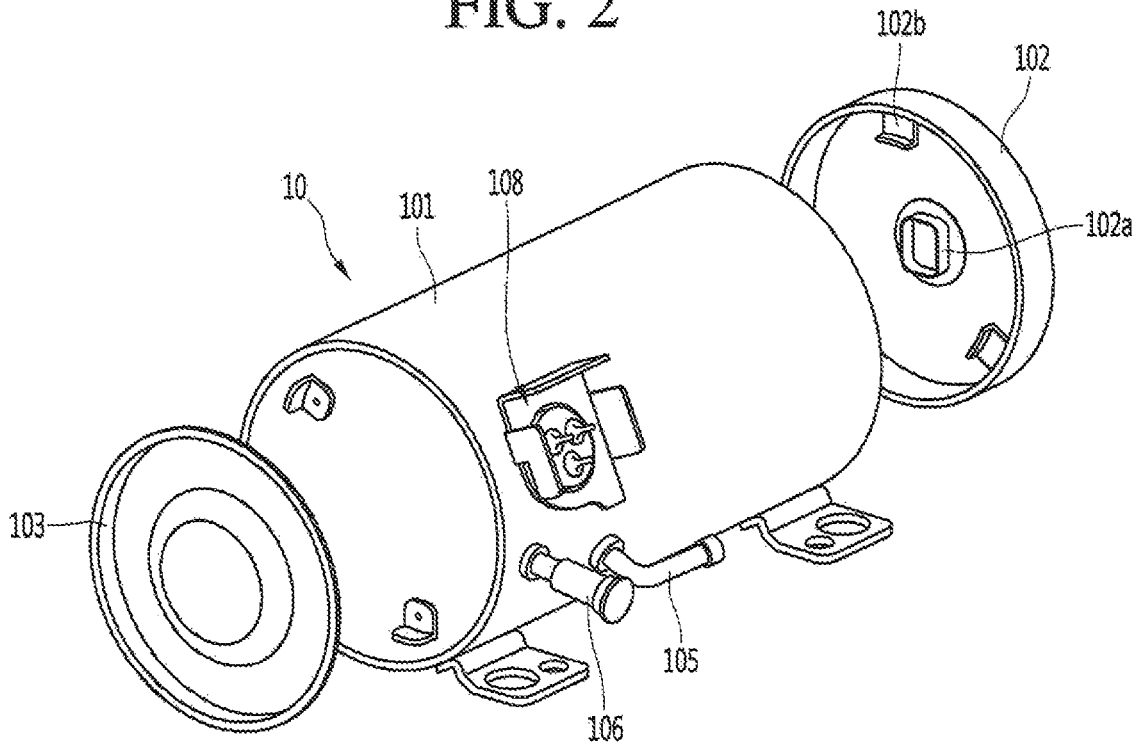
FIG. 2 is an exploded perspective view illustrating a shell and a shell cover of the linear compressor according to an embodiment.

FIG. 1 is a perspective view illustrating an outer appearance of a linear compressor according to an embodiment. FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101.

A leg 50 may be coupled to a lower portion of the shell 101. The leg 50 may be coupled to a base of a product in which the linear compressor 10 is installed or provided. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may transmit external power to a motor (see reference numeral 140 of FIG. 3) of the linear compressor 10. The terminal 108 may be connected to a lead line of a coil (see reference numeral 141*c* ref FIG. 3).

A bracket 109 may be installed or provided outside of the terminal 108. The bracket 109 may include a plurality of brackets that surrounds the terminal 108. The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 102 and 103 may be disposed to face each other.

The linear compressor 10 further includes a plurality of pipes 104, 105, and 106 provided in the shell 101 or the shell covers 102 and 103 to suction, discharge, or inject the refrigerant. The plurality of pipes 104, 105, and 105 may include a suction pipe 104 through which the refrigerant may be suctioned into the linear compressor 10, a discharge pipe 106 through which the compressed refrigerant may be discharged from the linear compressor 10, and a process pipe through which the refrigerant may be supplemented to the linear compressor 10.

For example the suction pipe 104 may be coupled to the first shell cover 102. The refrigerant may be suctioned into the linear compressor 10 through the suction pipe 104 in the axial direction.

The discharge pipe 105 may be connected to the shell 101. The refrigerant suctioned through the suction pipe 104 may be compressed in a compression space, which will be described hereinafter, while flowing in the axial direction. Also, the compressed refrigerant may be discharged through the discharge pipe 105 to the outside of the compressor 10. The discharge pipe 105 may be disposed at a position which is adjacent to the second shell cover 103 rather than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height different from a height of the discharge pipe 105 to avoid interference with the discharge pipe 105. The height may be understood as a distance from the leg 50 in the vertical direction (or the radial direction). As the discharge pipe 105 and the process pipe 106 are coupled to the outer circumferential surface of the shell 101 at the heights different from each other, a worker's work convenience may be improved.

A first stopper 102*b* may be disposed or provided on the inner surface of the first shell cover 102. The first stopper 102*b* may prevent the compressor body 100, particularly, the motor 140 from being damaged by vibration or an impact, which occurs when the linear compressor 10 is carried.

The first stopper 102*b* may be disposed adjacent to a back cover 170, which will be described hereinafter. When the linear compressor 10 is shaken, the back cover 170 may come into contact with the first stopper 102*b* to prevent the motor 140 from directly colliding, with the shell 101.

Figure 3:
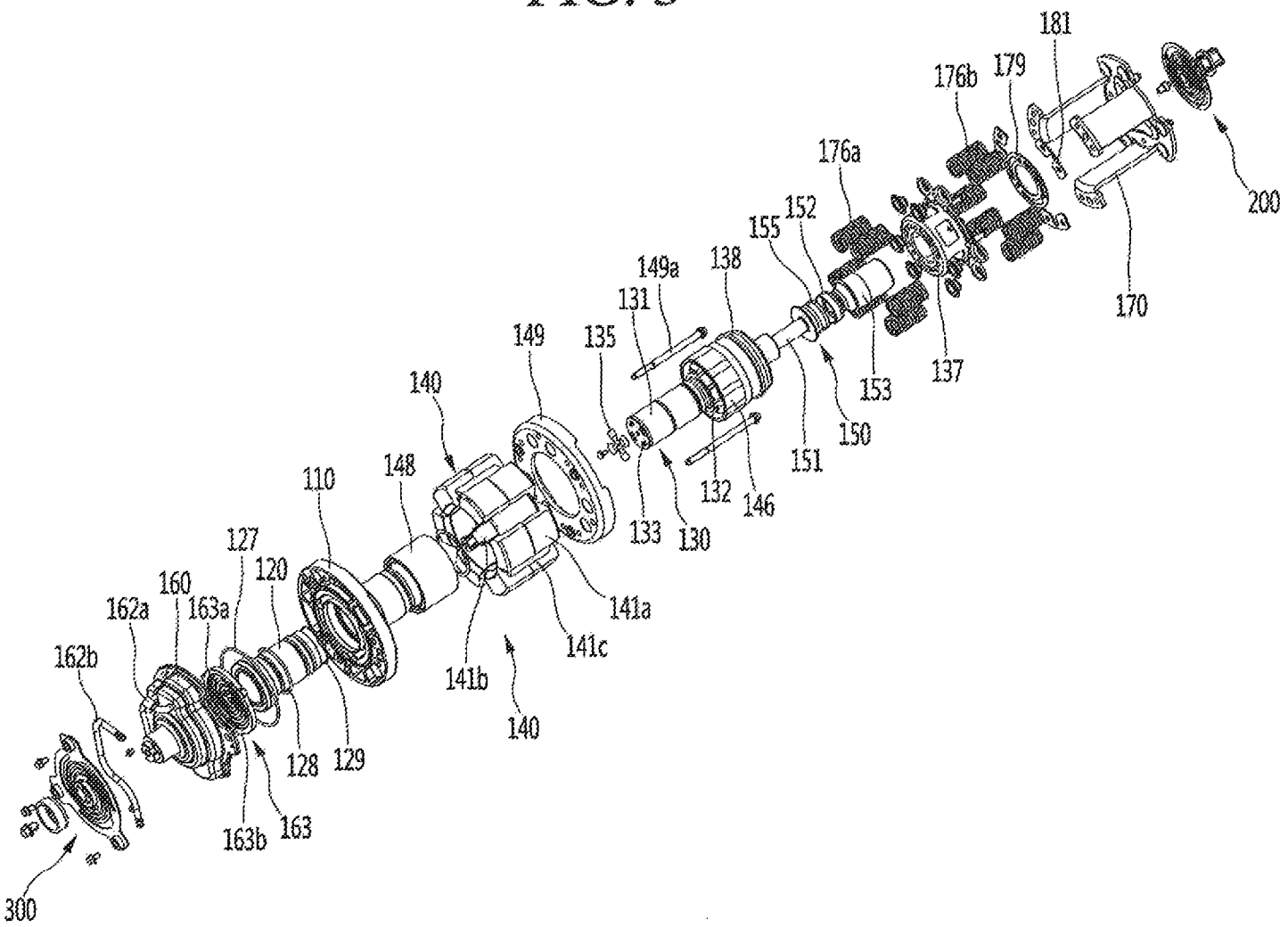
FIG. 3 is an exploded perspective view illustrating internal parts or components of the linear compressor according to an embodiment.
Figure 4:
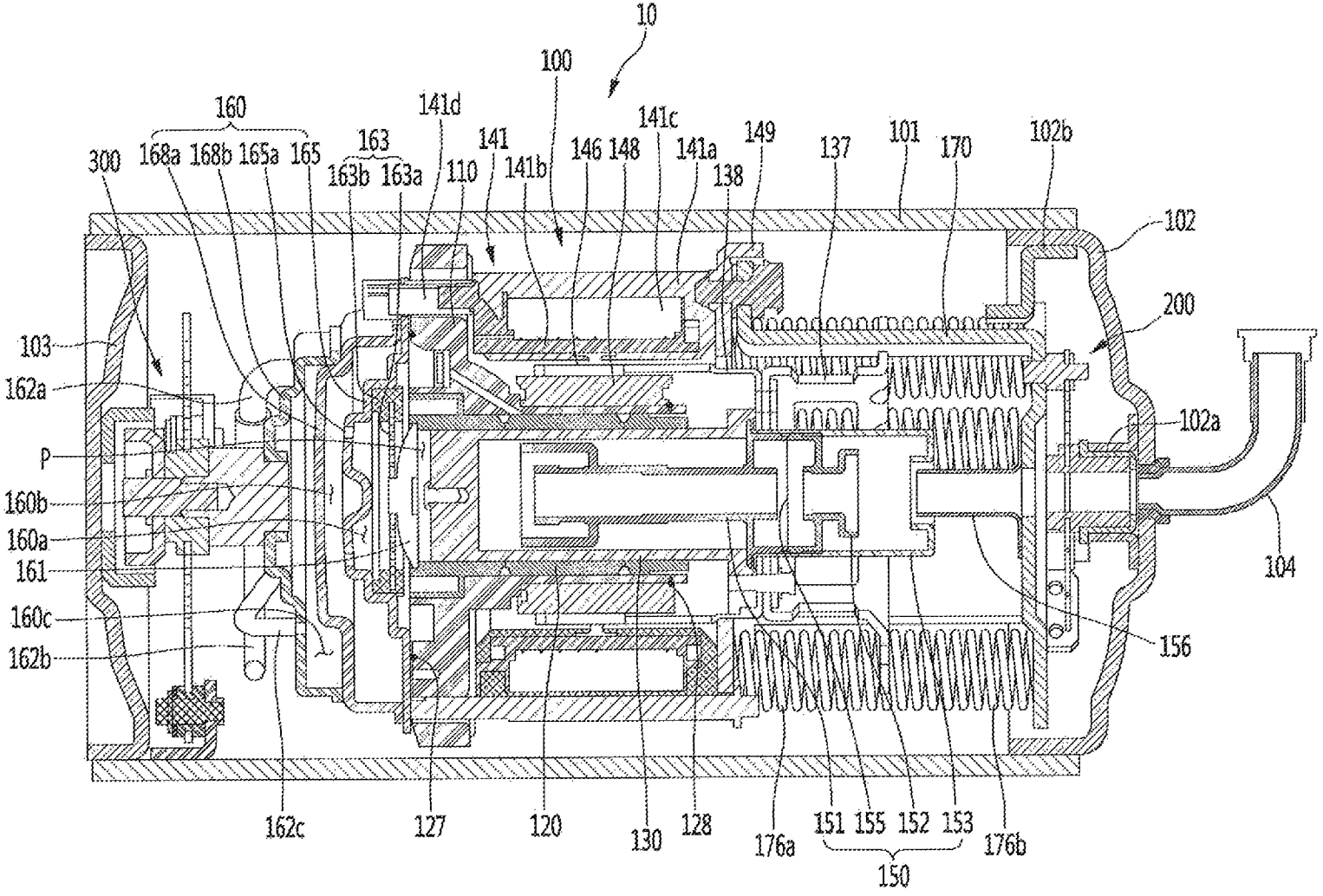
FIG. 4 is a cross-sectional view, taken along line of FIG. 1.

FIG. 3 is an exploded perspective view illustrating internal parts or components of the linear compressor according to an embodiment. FIG. 4 is a cross-sectional view, taken along line I-I' of FIG. 1.

Referring to FIGS. 3 and 4, the linear compressor 10 according to an embodiment may include the shell 101, a compressor body 100 accommodated in the shell 101, and a plurality of support devices or supports 200 and 300 that supports the compressor body 100. One of the plurality of support devices 200 and 300 may be fixed to the shell 101, and the other one may be fixed to a pair of covers 102 and 103. As a result, the compressor body 100 may be supported to be spaced apart from the inner circumferential surface of the shell 101.

The compressor body 100 may include a cylinder 120 provided in the shell 101, a piston 130 that linearly reciprocates within the cylinder 120, and a motor 140 that applies a drive force to the piston 130. When the motor 140 is driven, the piston 130 may reciprocate in the axial direction.

The compressor body 100 may further include a suction muffler 150 coupled to the piston 130 to reduce noise generated from the refrigerant suctioned through the suction pipe 104. The refrigerant suctioned through the suction pipe 104 may flow into the piston 130 via the suction muffler 150. For example, while the refrigerant passes through the suction muffler 150, a flow noise of the refrigerant may be reduced.

The suction muffler 150 may include a plurality of mufflers 151, 152, and 153. The plurality of mufflers 151, 152, and 153 may include a first muffler 151, a second muffler 152, and a third muffler 153, which may be coupled to each other.

The first muffler 151 may be disposed or provided within the piston 130, and the second muffler 152 may be coupled to a rear portion of the first muffler 151. Also, the third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 may further include a muffler filter 155. The muffler filter 155 may be disposed on or at an interface on or at which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" may be understood as a direction in which the piston 130 reciprocates, that is, a horizontal direction in FIG. 4. Also, "in the axial direction", a direction from the suction pipe 104 toward a compression space P, that is, a direction in which the refrigerant flows may be defined as a "frontward direction", and a direction opposite to the frontward direction may be defined as a "rearward direction". When the piston 130 moves forward, the compression space P may be compressed. On the other hand, the "radial direction" may be understood as a direction which is perpendicular to the direction in which the piston 130 reciprocates, that is, a vertical direction in FIG. 4. The "axis of the compressor body" may represent a central line or central longitude axis in the axial direction of the piston 130.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 135 that selectively opens the suction hole 133 may be disposed or provided on a front side of the suction hole 133. A coupling hole, to which a predetermined coupling member 135*a* may be coupled, may be defined in an approximately central portion of the suction valve 135.

A discharge cover 160 that defines a plurality of discharge spaces for the refrigerant discharged from the compression space P and a discharge valve assembly 161 and 163 coupled to the discharge cover assembly 160 to selectively discharge the refrigerant compressed in the compression space P may be provided at a front side of the compression space P. The discharge cover assembly 160 may include a discharge cover 165 coupled to a front surface of the cylinder 120 to accommodate the discharge valve assembly 161 and 163 therein and a plurality of discharge mufflers coupled to a front surface of the discharge cover 165. The plurality of discharge mufflers may include a first discharge muffler 168*a* coupled to the front surface of the discharge cover 165 and a second discharge muffler 168*b* coupled to a front surface of the first discharge muffler 168*a*; however, the number of discharge mufflers are not limited thereto.

The plurality of discharge spaces may include a first discharge space 160*a* defined inside of the discharge cover 165, a second discharge space 160*b* defined between the discharge cover 165 and the first discharge muffler 168*a*, and a third discharge space 160*c* defined between the first discharge muffler 168*a* and the second discharge muffler 168*b*. The discharge valve assembly 161 and 163 may be accommodated in the first discharge space 160*a*.

One or a plurality of discharge holes 165*a* may be defined in the discharge cover 165, and the refrigerant discharged into the first discharge space 160*a* may be discharged into the second discharge space 160*b* through the discharge hole 165*a* and thus is reduced in discharge noise.

The discharge valve assembly 161 and 63 may include a discharge valve 161, which may be opened when a pressure of the compression space P is above a discharge pressure to introduce the refrigerant into the discharge space of the discharge cover assembly 160 and a spring assembly 163 fixed to the inside of the discharge cover 165 to provide elastic force in the axial direction to the discharge valve 161. The spring assembly 163 may include a valve spring 163*a* that applies elastic force to the discharge valve 161 and a spring support part or support 163*b* that supports the valve spring 163*a* to the discharge cover 165.

For example, the valve spring 163*a* may include a plate spring. Also, the spring support part 163*b* may be integrally injection-molded to the valve spring 163*a* through an insertion-molding process.

The discharge valve 161 may be coupled to the valve spring 163*a* and a rear portion or a rear surface of the discharge valve 161 may be disposed to be supported on the front surface of the cylinder 120. When the discharge valve 161 is closely attached to the front surface of the cylinder 120, the compression space P may be maintained in a sealed state. When the discharge valve 161 is spaced apart from the front surface of the cylinder 120, the compression space P may be opened to discharge the refrigerant compressed in the compression space P to the first discharge space 160*a*.

The compression apace P may be a space defined between the suction valve 135 and the discharge valve 161. Also, the suction valve 135 may be disposed on or at one side of the compression space P, and the discharge valve 161 may be disposed on or at the other side of the compression space P, that is, an opposite side of the suction valve 135.

While the piston 130 linearly reciprocates within the cylinder 120, when a pressure of the compression space P is less than a pressure inside of the suction muffler 150, the suction valve 135 may be opened, and the refrigerant introduced into the suction muffler 150 suctioned into the compression space P. Also, when the refrigerant increases in flow rate, and thus, the pressure of the compression space P is greater than the pressure inside of the suction muffler 150, the suction valve 135 may be closed to become a state in which the refrigerant is compressible.

When the pressure of the compression space P is greater than the pressure of the first discharge space 106*a*, the valve spring 163*a* may be elastically deformed forward to allow the discharge valve 161 to be spaced apart from the front surface of the cylinder 120. Also, when the discharge valve 161 is opened, the refrigerant may be discharged from the compression space P to the first discharge space 160*a*. When the pressure of the compression space P is less than the pressure of the first discharge space 160*a* by the discharge of the refrigerant, the valve spring 163*a* may provide a restoring force to the discharge valve 161 to allow the discharge valve 161 to be closed.

The compressor body 100 may further include a connection pipe 62*c* that connects the second discharge space 160*b* to the third discharge space 160*c*, a cover pipe 162*a* connected to the second discharge muffler 168*b* and a loop pipe 162*b* that connects the cover pipe 162*a* to the discharge pipe 105. The connection pipe 162*c* may have one or a first end that passes through the first discharge muffler 168*a* and inserted into the second discharge space 160*b* and the other or a second end connected to the second discharge muffler 158*b* to communicate with the third discharge space 160*c*. Thus, the refrigerant discharged to the second discharge space 160*b* may be further reduced in noise while moving to the third discharge pace 160*c* along the connection pipe 162*c*. Each of the pipes 162*a*, 162*b*, and 162*c* may be made of a metal material.

The loop pipe 162*b* may have one or a first side or end coupled to the cover pipe 162*a* and the other or a second side or end coupled to the discharge pipe 105. The loop pipe 162*b* may be made of a flexible material. Also, the loop pipe 162*b* may roundly extend from the cover pipe 162*a* along the inner circumferential surface of the shell 101 and be coupled to the discharge pipe 105. For example, the loop pipe 162*b* may be provided in a wound shape. While the refrigerant flows along the loop pipe 162*b*, noise may be further reduced.

The compressor body 100 may further include a frame 110. The frame 110 may be a part that fixes the cylinder 120. For example, the cylinder 120 may be press-fitted into the frame 110.

The frame 110 may be disposed or provided to surround the cylinder 120. That is, the cylinder 120 may be inserted into an accommodation groove defined in the frame 110. Also, the discharge cover assembly 160 may be coupled to a front surface of the frame 110 by using a coupling member.

The compressor body 100 may further include the motor 140. The motor 140 may include an outer stator 141 fixed to the frame 110 to surround the cylinder 120, an inner stator 148 disposed or provided to be spaced inward from the outer stator 141, and a permanent magnet 146 disposed or provided in a space between the outer stator 141 and the inner stator 148.

The permanent magnet 146 may be linearly reciprocated by mutual electromagnetic force between the outer stator 141 and the inner stator 148. Also, the permanent magnet 146 may be provided as a single magnet having one polarity or by coupling a plurality of magnets having three polarities to each other.

The permanent magnet 146 may be disposed or provided on the magnet frame 138. The magnet frame 138 may have an approximately cylindrical shape and be disposed or provided to be inserted into the space between the outer stator 141 and the inner stator 148.

Referring to the cross-sectional view of FIG. 4, the magnet frame 138 may be bent forward after extending from the outer circumferential surface of the piston flange part or flange 132 in the radial direction. The permanent magnet 146 may be fixed to a front end of the magnet frame 138. Thus, when the permanent magnet 146 reciprocates, the piston 130 may reciprocate together with the permanent magnet 146 in the axial direction.

The outer stator 141 may include coil winding bodies 141*b*, 141*c*, and 141*d*, and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141.

The stator core 141*a* may include a plurality of core blocks in which a plurality of laminations are laminated in a circumferential direction. The plurality of core blocks may be disposed or provided to surround at least a portion of the coil winding bodies 141*b* and 141*c*.

A stator cover 149 may be disposed on one or a first side of the outer stator 141. That is the outer stator 141 may have one or a first side supported by the frame 110 and the other or a second side supported by the stator cover 149.

The linear compressor 10 may further include a cover coupling member 149*a* that couples the stator cover 149 to the frame 110. The cover coupling member 149*a* may pass through the stator cover 149 to extend forward to the frame 110 and then be coupled to the frame 110.

The inner stator 148 may be fixed to an outer circumference of the frame 110. Also, in the inner stator 148, the plurality of laminations may be laminated outside of the frame 110 in the circumferential direction.

The compressor body 100 may further include a support 137 that supports the piston 130. The support 137 may be coupled to a rear portion of the piston 130 and the muffler 150 may be disposed or provided to pass through the inside of the support 137. The piston flange part 132, the magnet frame 138, and the support 137 may be coupled to each other using a coupling member.

A balance weight 179 may be coupled to the support 137. A weight of the balance weight 179 may be determined based on a drive frequency range of the compressor body 100.

The compressor body 100 may further include a back cover 170 coupled to the stator cover 149 to extend backward. The back cover 170 may include three support legs, however, embodiments are not limited thereto, and the three support legs may be coupled to a rear surface of the stator cover 149. A spacer 181 may be disposed or provided between the three support legs and the rear surface of the stator cover 149. A distance from the stator cover 149 to a rear end of the back cover 170 may be determined by adjusting a thickness of the spacer 181. The back cover 170 may be spring-supported by the support 137.

The compressor body 100 may further include an inflow guide part or guide 156 coupled to the back cover 170 to guide an inflow of the refrigerant into the muffler 150. At least a portion of the inflow guide part 156 may be inserted into the suction muffler 150.

The compressor body 100 may further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the back cover 170. The piston 130 that reciprocates within the linear compressor 10 may be stably moved by the action of the plurality of resonant springs 176*a* and 176*b* to reduce vibration or noise due to the movement of the piston 130.

The compressor body 100 may further include a plurality of sealing members or seals 127 and 128 that increases a coupling force between the frame 110 and the peripheral parts or portions around the frame 110. The plurality of sealing members 127 and 128 may include a first sealing member or seal 127 disposed or provided at a portion at which the frame 110 and the discharge cover 165 are coupled to each other. The plurality of sealing members 127 and 128 may further include a second sealing member or seal 128 disposed or provided at a portion at which the frame 110 and the cylinder 120 are coupled to each other. Each of the first and second sealing members 127 and 128 may have a ring shape.

The plurality of support devices 200 and 300 may include a first support device or support 200 coupled to one or a first side of the compressor body 100 and a second support device or support 300 coupled to the other or a second side of the compressor body 100. The first support device 200 may be fixed to the first shell cover 102, and the second support device 300 may be fixed to the shell 101.

Figure 5:
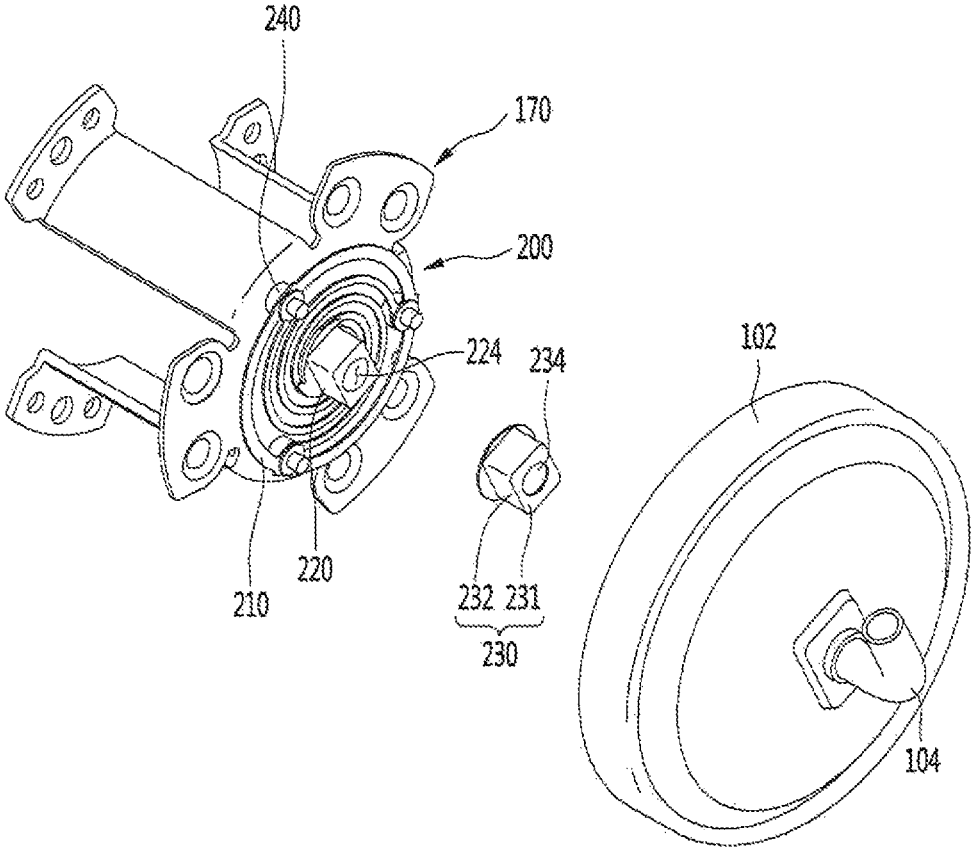
FIGS. 5 and 6 are perspective views of a first support device or support according to an embodiment.
Figure 6:
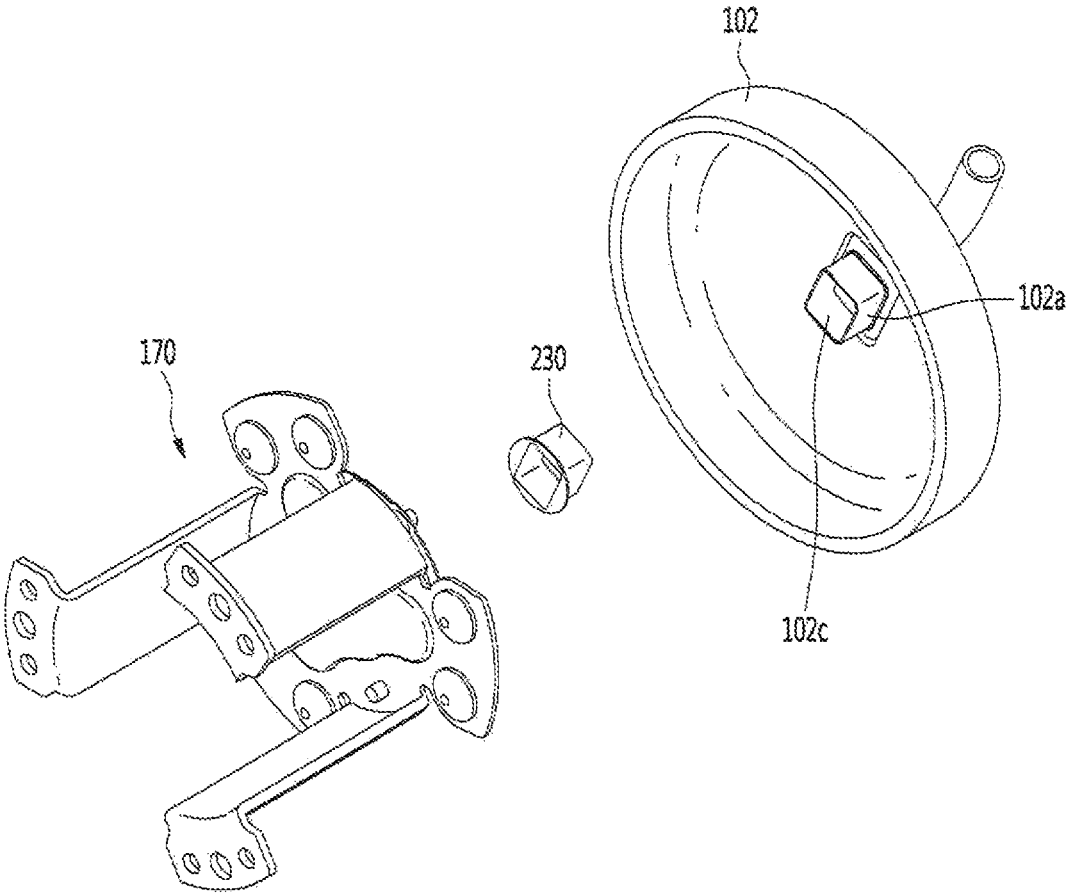
Figure 7:
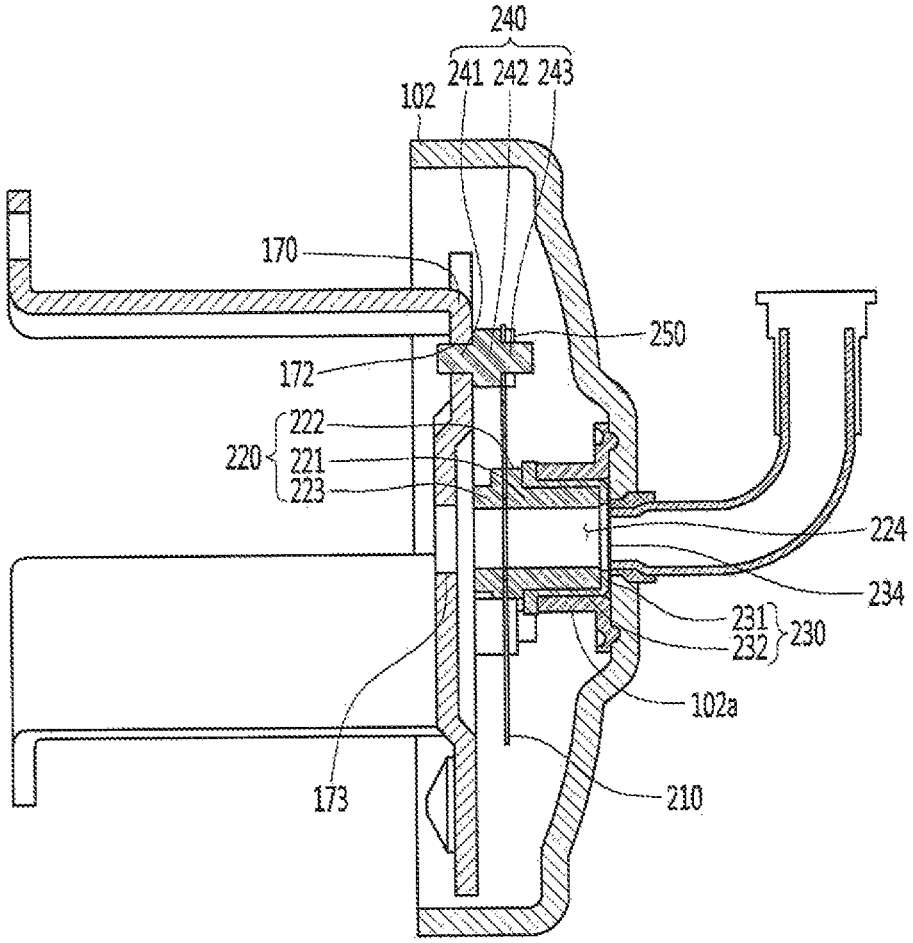
FIG. 7 is a view illustrating a state in which the first support device is connected to a first shell cover.
Figure 8:
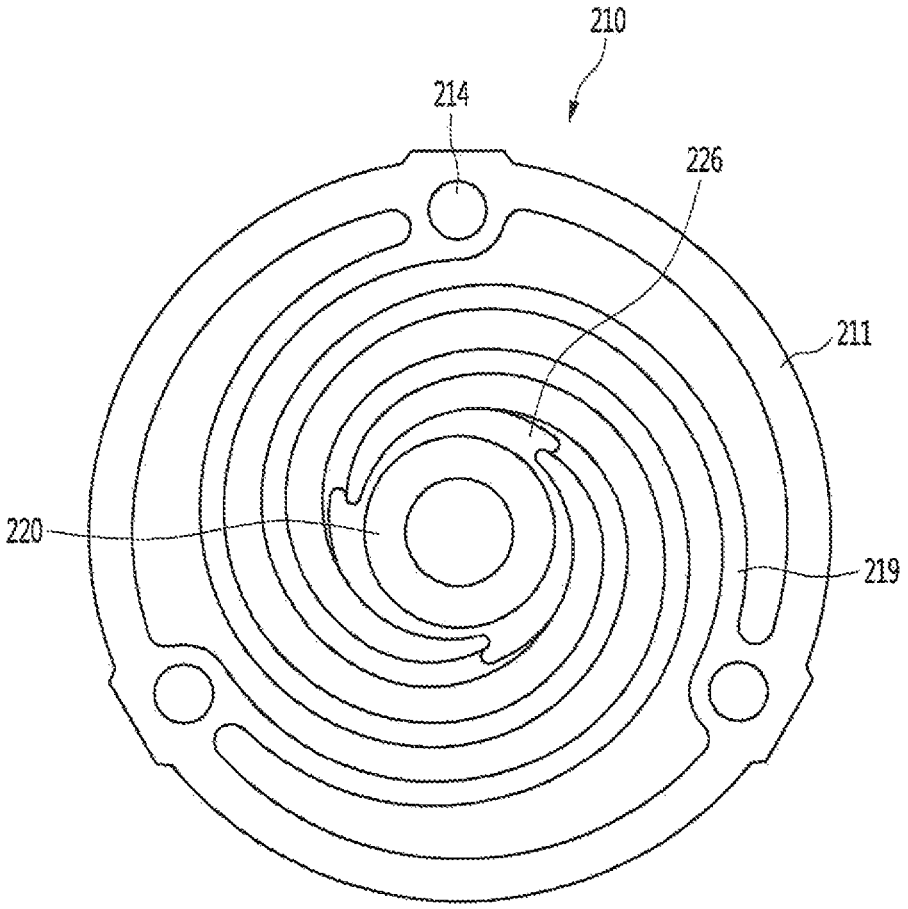
FIG. 8 is a plan view illustrating a state in which a first spring connection part or portion is coupled to a first plate spring.
Figure 9:
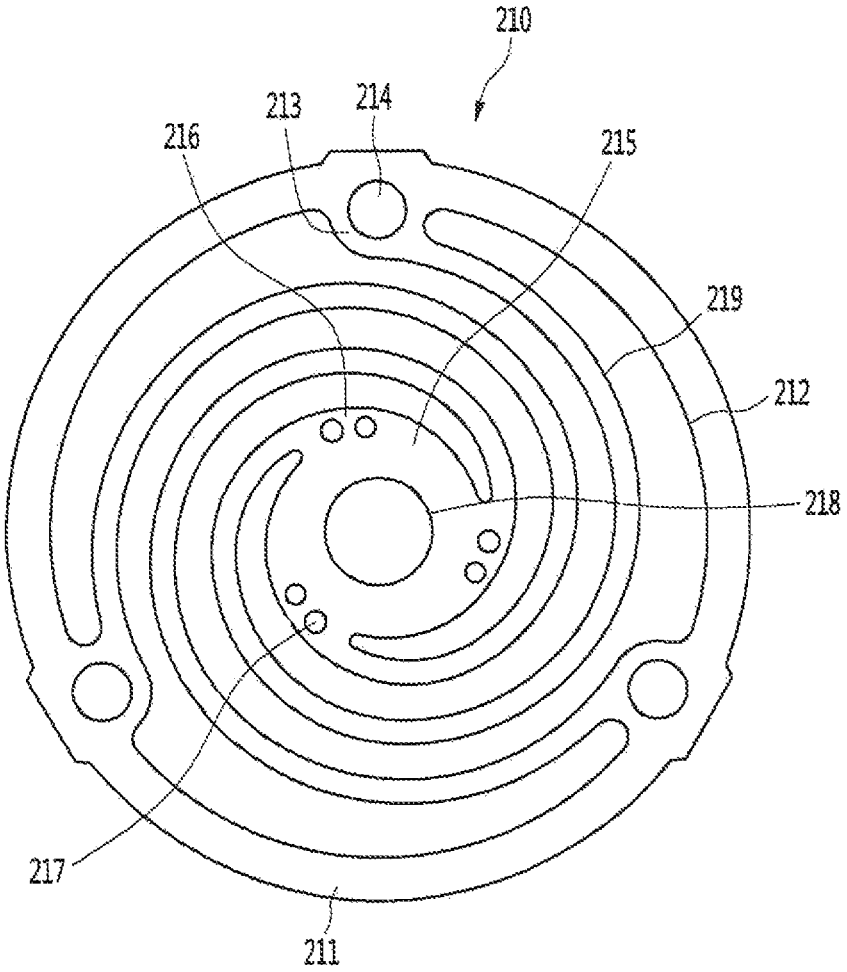
FIG. 9 is a plan view of the first plate spring.

FIGS. 5 and 6 are perspective views of a first support device or support according to an embodiment. FIG. 7 is a view illustrating a state in which the first support device is connected to a first shell cover. FIG. 8 is a plan view illustrating a state in which a first spring connection part or portion is coupled to a first plate spring. FIG. 9 is a plan view of the first plate spring.

Referring to FIGS. 5 to 9, the first support device 200 may be coupled to the first shell cover 102 in a state of being connected to one side of the compressor body 100. The first support device 200 may be coupled to the first shell cover 102 in a state of being spaced apart from the inner circumferential surface of the shell 101. For example, FIG. 7 illustrates a state in which the first support device 200 is coupled to the first shell cover 102.

Although not limited thereto, the first support device 200 may be disposed at a central portion of the first shell cover 102. In this case, the axial of the compressor body 100 may pass through the central portion of the first shell cover 102 and thus, the vibration of the compressor body 100 in the radial direction may be minimized while the compressor body 100 operates.

The first support device 200 may include a first plate spring 210. When the first support device 200 is coupled to the first shell cover 102, the first plate spring 210 may be fixed to the back cover 170. Also, the first plate spring 210 may be disposed to stand up within the shell 101 so that the axis of the compressor body 100 passes through a center of the first plate spring 210.

When the first support device 200 includes the first plate spring 210, the first support device 200 may be reduced in size. In addition, vibration of the compressor body 100 may be effectively absorbed, and also collision between the compressor body 100 and the shell 101 may be prevented by large transverse stiffness (stiffness a direction perpendicular to an axial direction of the compressor body) and small longitudinal stiffness (stiffness in the axial direction of the compressor body), which correspond to characteristics of the first plate spring 210.

The first support device 200 may further include a first spring connection part or portion 220 connected to the first plate spring 210. The first spring connection part 220 may allow the first support device 200 to be easily coupled to the first shell cover 102.

A cover support part or portion 102*a* that couples the first support device 200 may be provided on the first shell cover 102. The cover support part 102*a* may be integrated with the first shell cover 102 or coupled to the first shell cover 102.

The first spring connection part 220 may be inserted into an accommodation part 102*c* of the cover support part 102*a*. A buffer part or buffer 230 may be disposed between the first spring connection part 220 and the cover support part 102*a*. Thus the vibration transmitted from the first spring connection part 220 may not be transmitted to the cover support part 102*a*, but be absorbed by the buffer part 230.

The buffer part 230 may be made of a rubber material or a material which is capable of absorbing an impact while being deformed by external force. Although not limited thereto, the buffer part 230 may be fitted into the cover support part 102*a*, and the first spring connection part 220 may be fitted into the buffer part 230.

Each of the accommodation part 102*c* of the cover support part 102*a* and the buffer part 230 may have a non-circular cross-section so that the buffer part 230 does not relatively rotate with respect to the cover support part 102*a*. Also, a portion of the first spring connection part 220, which is inserted into the buffer part 230, may have a non-circular cross-section so that the first spring connection part 220 does not relatively rotate with respect to the buffer part 230.

The buffer part 230 may include a first contact surface 231 that contacts the first spring connection part 220 in the axial direction to absorb the vibration transmitted from the first support device 200 in the axial direction and a second contact surface 232 that contacts the first spring connection part 220 in the radial direction to absorb the vibration transmitted from the first support device 200 in the radial direction.

The second contact surface 232 may have a shape that surrounds at least a portion of the first spring connection part 220. Also, an opening 234 through which the refrigerant passes may be defined in the first contact surface 231.

According to this embodiment, the first support device 200 may be coupled to the first shell cover 102. As the buffer part 230 is disposed between the first support device 200 and the first shell cover 102, transmission of vibration, which is generated while the compressor body 100 operates, into the shell 101 through the first shell cover 102 may be minimized.

In case of this embodiment, the vibration of the compressor body 100 in the axial direction may be absorbed by the first plate spring 210, and the vibration of the compressor body 100 in the radial direction may be absorbed by the buffer part 230. Thus, the transmission of the vibration of the compressor body 100 into the shell 101 through the first shell cover 102 may be effectively reduced.

A refrigerant passage 224 through which the refrigerant suctioned through the suction pipe 104 passes may be defined in the central portion of the first spring connection part 220. For example, in a state in which the first spring connection part 220 is fitted into the buffer part 230, the refrigerant passage 224 may be aligned with the opening 234 of the buffer part 230.

The first plate spring 210 may include an outer rim 211, an inner rim 215, and a plurality of connection parts or portions 219 having a spirally rounded shape and connecting the outer rim 211 to the inner rim 215. More particularly, the plurality of connection parts 219 may be formed by a plurality of spiral holes defined inside of a metal plate having an approximately circular shape.

A plurality of rounded extension parts or portions 216 may be spaced apart from the inner rim 215 in the circumferential direction on an outer edge of the inner rim 215. Also, the plurality of connection parts 219 may be connected to the plurality of rounded extension parts 216, respectively.

A through-hole through which the first spring connection part 220 may pass may be defined in a center of the metal plate having the approximately circular shape. Also, a hole or slit extending in a spiral shape from an outer edge to an inner edge of the metal plate may be defined. A plurality of the hole or slit may be provided to form the first plate spring 210 having a predetermined elasticity.

That is, an outermost edge of the plurality of holes or slits extending in the spiral shape may be located at a point which is spaced a predetermined distance from the outer edge of the metal plate in a circumferential direction. Also, an innermost edge of the plurality of holes or slits may be located at a point which is spaced a predetermined distance from the inner edge of the metal plate in the circumferential direction. A boundary between the plurality of holes or slits may be defined as the connection part 219.

The first spring connection part 220 may be integrally formed with the inner rim 215 by insert injection molding, for example. The first spring connection part 220 may include a first portion that contacts with a first surface of the inner rim 215 a second portion 222 that contacts a second surface which is opposite to the first surface, and a third portion 223 that passes through the through-hole 218 defined inside the inner rim 215 to connect the first portion 221 to the second portion 222 to prevent the first spring connection part 220 from being separated in the axial direction of the compressor body 100 in a state in which the first spring connection part 220 is insert-injection-molded to the inner rim 215.

The third portion 223 may pass through the through-hole 218, and the first and second portions 221 and 222 may extend from an outer circumferential surface of the first portion 223 in the radial direction. Also, the first portion 221 and the second portion 222 may be spaced a distance corresponding to a thickness of the first plate spring 210 from each other.

Thus each of the first and second portions 221 and 222 may have a diameter greater than a diameter of the through-hole 218 of the inner rim 215. That is, each of the first and second portions 221 and 222 may have a diameter greater than a diameter of the third portion 223. Also, when the first spring connection part 220 is completely inserted into the buffer part 230, a rear end of the third portion 223 may come into contact with the first contact surface 231 of the buffer part 230.

At least one hole 217 may be defined in the extension part 216 so that the first spring connection part 220 does not relatively rotate with respect to the first plate spring 210 in a state in which the first spring connection part 220 is inset injection-molded to the first plate spring 210. A plurality of holes 217 may be spaced apart from each other in the circumferential direction of the inner rim 215. The plurality of holes 217 may be defined in or at positions which are spaced apart from the through-hole 218 of the inner rim 215 in the radial direction.

While the first spring connection part 220 is insert-injection-molded to the first plate spring 210, a resin solution for forming the first spring connection part 220 may be filled into the plurality of holes 217. Thus, after the first spring connection part 220 is insert-injection-molded to the first plate spring 210, the resin solution filled into the plurality of holes 217 may be cured to act as rotation resistance, thereby preventing the first spring connection part 220 from relatively rotating with respect to the first plate spring 210.

If the first plate spring 210 and the first spring connection part 220 relatively rotate with respect to each other in a state in which the first plate spring 210 is fixed to the compressor body 100, and the first spring connection part 220 is fixed to the first shell cover 102, the compressor body 100 may rotate around the axis while the compressor body 100 operates, increasing vibration of the compressor body 100 in the radial direction and/or the circumferential direction.

However, according to this embodiment, as the relative rotation between the plate spring 210 and the spring connection part 220 is prevented, the vibration of the compressor body 100 in the radial direction and/or the circumferential direction while the compressor body 100 operates may be reduced.

The first spring connection part 220 may further include a rounded extension part or portion 226 having a same shape as each of the rounded extension parts 216 of the inner rim 215. The extension part 226 may be disposed or provided in the same shape on front and rear surfaces of the first plate spring 210, and then, the front extension part and the rear extension part may be connected by the resin solution filled into the plurality of holes 217.

A plurality of internal extension parts or portions 213 may be disposed or provided on an inner circumferential surface 212 of the outer rim 211. The plurality of internal extension parts 213 may be disposed or provided to be spaced apart from each other in the circumferential direction of the outer rim 211, and the plurality of connection parts 219 may be respectively connected to the plurality of internal extension parts 213.

In this embodiment, each as of the internal extension parts 213 is connected to each of the connection parts 219, a possibility of damage of the connection point between the outer rim 211 and the connection part 219 due to vibration in the axial direction may be reduced.

A coupling hole 214 may be defined in each of the plurality of internal extension parts 213, and a back cover coupling member 240 that couples the first plate spring 210 to the back cover 170 may pass through the coupling hole 214. The back cover coupling member 240 may include a cover insertion part or portion 241 that passes through the coupling hole 172 of the back cover 170, a contact part or portion 242 corning into contact with the back cover 170, and a spring insertion part or portion 243 that passes through the coupling hole 214 of the first plate spring 210.

The contact part 242 may have a diameter greater than a diameter of each of the cover insertion part 241 and the spring insertion part 243. Thus, when the cover insertion part 241 is inserted into the coupling hole 172 of the back cover 170 to allow the contact part 242 to be closely attached to the back cover 170 the first plate spring 210 and the back cover 170 may be spaced a length of the contact part 242 from each other. A washer 250 may be coupled to the spring insertion part 243 to prevent the first plate spring 210 from being separated from the back cover coupling member 240 in a state in which the spring insertion part 233 passes through the coupling hole 214 of the first plate spring 210.

A refrigerant opening 173 that communicates with the refrigerant passage 224 of the first spring connection part 220 may be defined in a center of the back cover 170.

Figure 10:
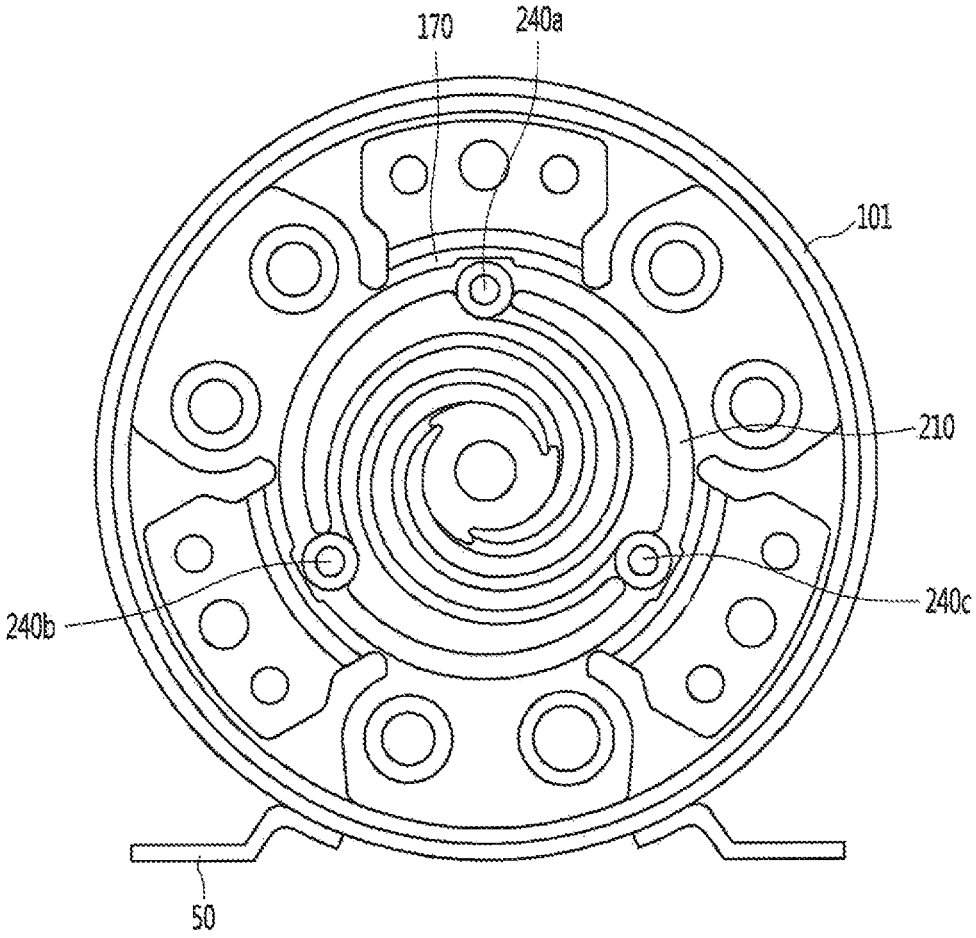
FIG. 10 is a view illustrating a state in which the first plate spring is installed on a back cover within the shell.

FIG. 10 is a view illustrating a state in which the first plate spring is installed on the back cover within the shell. Referring to FIGS. 7 and 10, the back cover coupling member 240 that couples the first plate spring 210 to the back cover 170 may include a plurality of back cover coupling members 240*a*, 240*b*, and 240*c*.

Although not limited thereto, three back cover coupling members 240*a*, 240*b*, and 240*c* may be provided. If the plurality of back cover coupling members 240*a*, 240*b*, and 240*c* are provided as two members, although a worker's work convenience is improved, a coupling force between the first plate spring 210 and the back cover 170 may be reduced. As a result, drooping due to the load of the compressor body 100 and the vibration of the compressor body 100 in the radial direction may increase.

On the other hand, if the plurality of back cover coupling members 240*a*, 240*b*, and 240*c* are provided as four members, although the coupling force between the first plate spring 210 and the back cover 170 increases, the worker's work convenience may be deteriorated, and also the structure may be complicated, causing interference with peripheral structure. Thus, the three back cover coupling members 240*a*, 240*b*, and 240*c* may be provided for worker's work convenience and maintenance of the coupling force between the first plate spring 210 and the back cover 170.

The three back cover coupling embers 240*a*, 240*b* and 240*c* may be spaced the same interval from each other in the circumferential direction of the first plate spring 210. The three back cover coupling members may be defined as a first cover coupling member 240*a*, a second cover coupling member 240*b*, and a third cover coupling member 240*c*.

The first cover coupling member 240*a* may be coupled to the back cover 170 at a position which is higher than a position of each of the second and third cover coupling members 240*b* and 240*c* with respect to the leg 50. Also, the second and third cover coupling members 240*b* and 240*c* may be disposed or provided at substantially the same height with respect to the leg 50.

As described above, according to the positions of the three cover coupling members 240*a* 240*b*, and 240*c*, as a center of gravity of the back cover 170, to which the first plate spring 210 is coupled, may be defined at a lowest point with respect to the leg 50, vibration of the compressor body 100 in the radial direction may be minimized.

Figure 11:
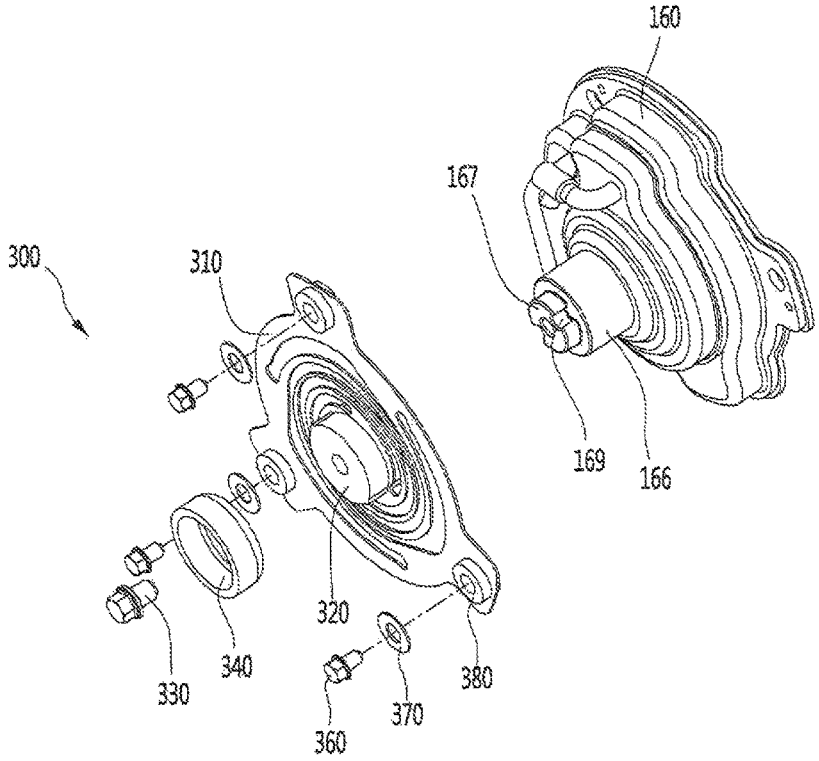
FIGS. 11 and 12 are exploded perspective views of a second support device or support according to an embodiment.
Figure 12:
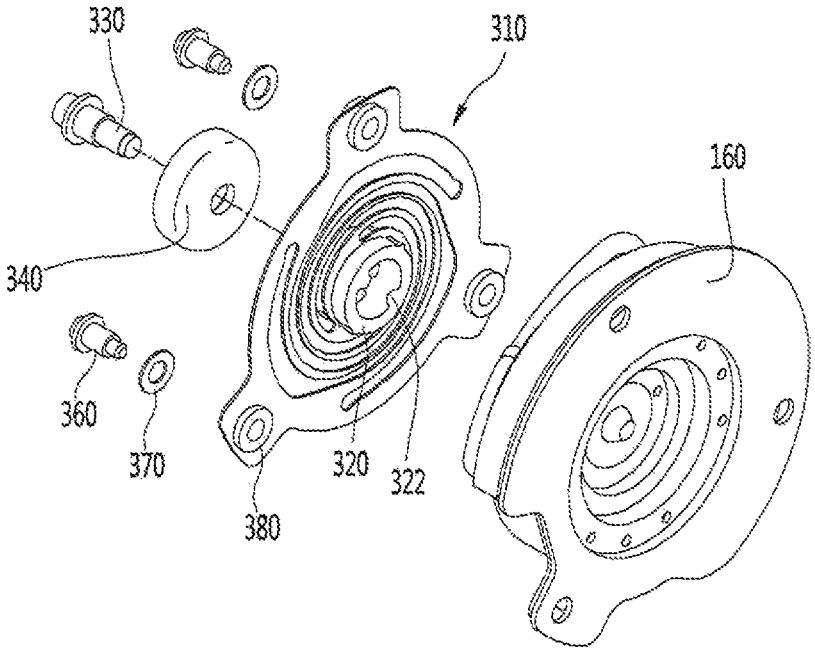
Figure 13:
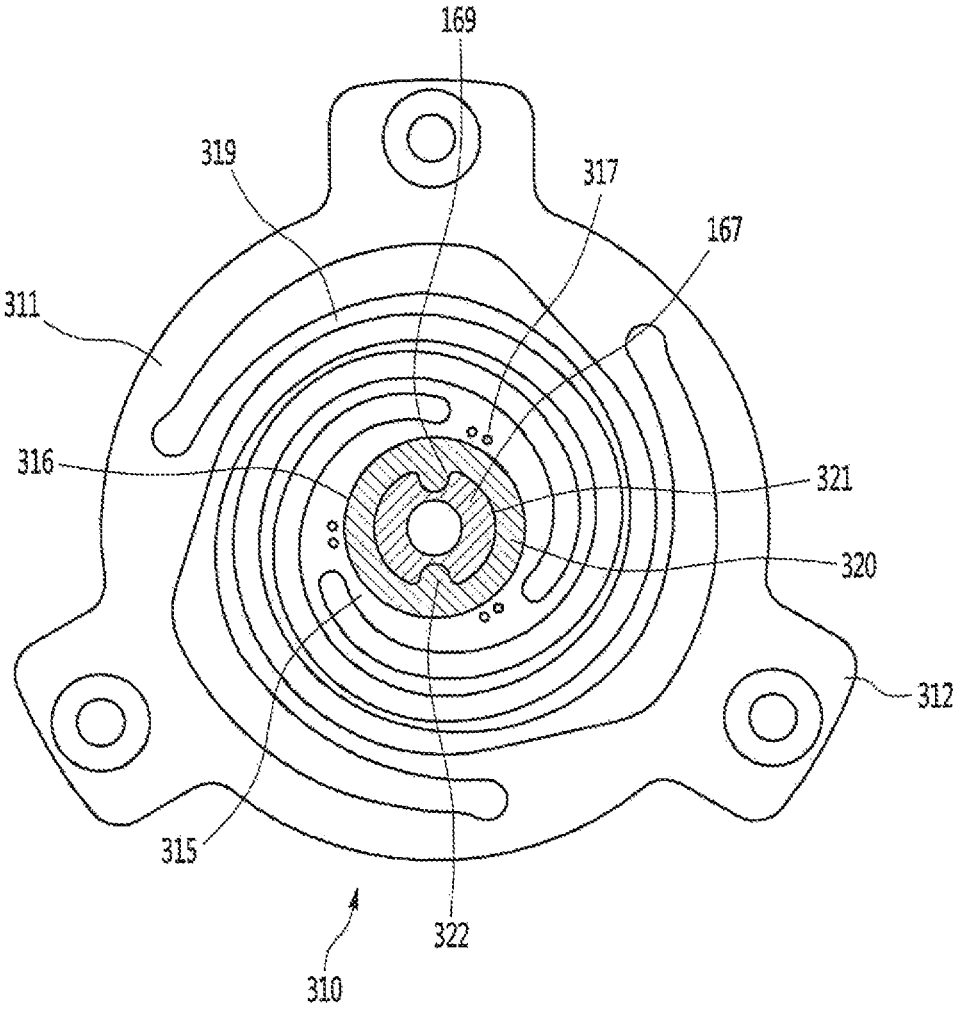
FIG. 13 is a cross-sectional view illustrating a state in which the second support device is coupled to a discharge cover according to an embodiment.
Figure 14:
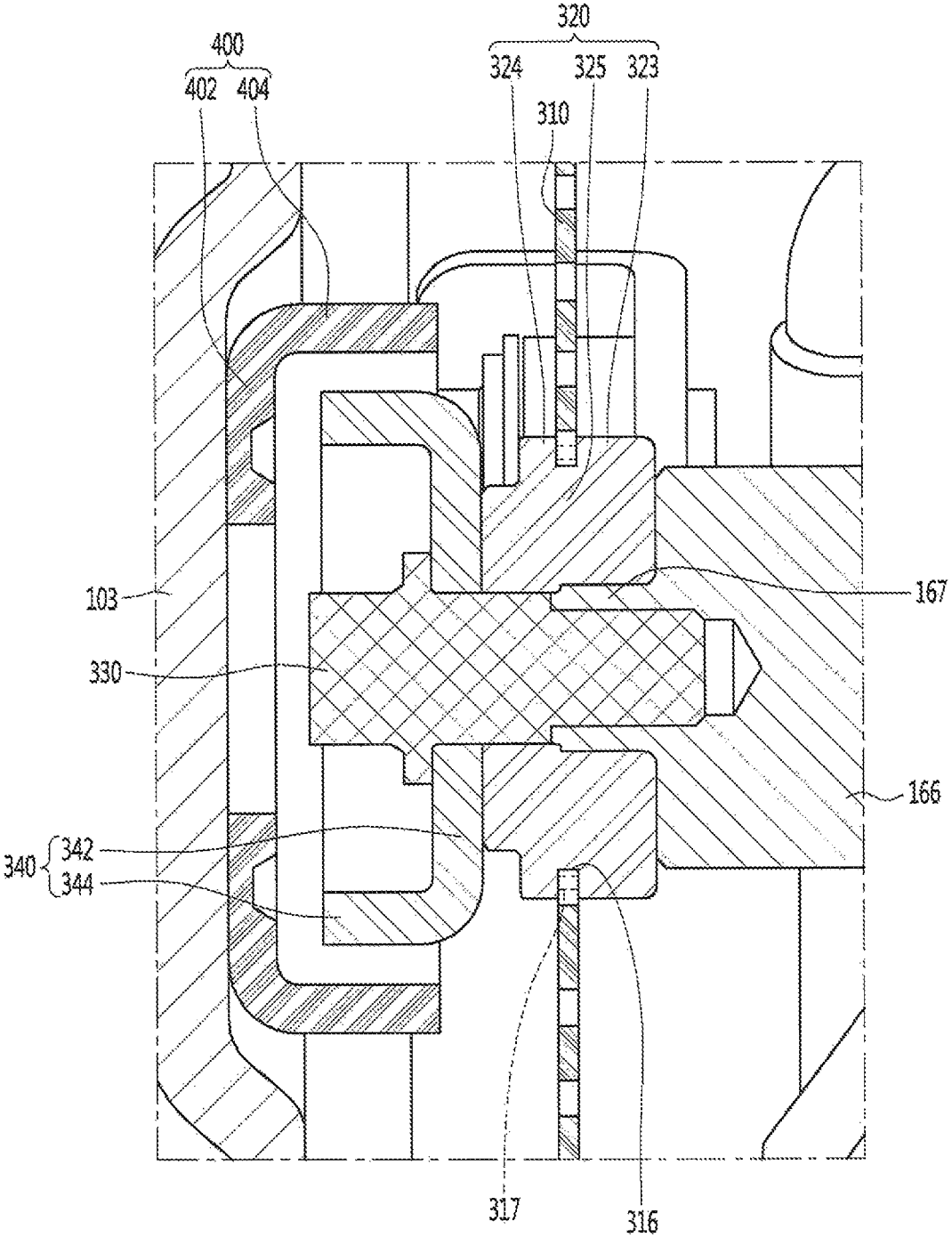
FIG. 14 is a cross-sectional view of the second support device.

FIGS. 11 and 12 are exploded perspective views of a second support device or support according to an embodiment. FIG. 13 is a cross-sectional view illustrating a state in which the second support device is coupled to the discharge cover according to an embodiment. FIG. 14 is a cross-sectional view of the second support device.

Referring to FIGS. 11 to 14, the second support device 300 may be coupled to the shell 101 in a state of being connected to the compressor body 100. The second support device 300 may include a second plate spring 310.

In this embodiment, as the second support device 300 is coupled to the shell 101, a phenomenon in which the compressor body 100 droops down may be reduced. When the drooping of the compressor body 100 is reduced, collision between the compressor body 100 and the shell 101 while the compressor body 100 operates may be prevented.

The second support device 300 may further include a second spring connection part 320 connected to a center of the second plate spring 310. The second spring connection part 320 may be coupled to the discharge cover assembly 160.

The discharge cover assembly 160 may include a cover protrusion 166 to which the second spring connection part 320 may be coupled. The cover protrusion 166 may be integrated with the discharge cover assembly 160 or coupled to the discharge cover assembly 160. As illustrated in FIG. 4, the cover protrusion 166 may be mounted on or at a central portion of the frontmost (or the outermost) discharge muffler 168*b*.

Also, an insertion part or portion 167 inserted into the second spring connection part 320 may protrude from a front surface of the cover protrusion 166. The insertion part 167 may have an outer diameter less than an outer diameter of the cover protrusion 166.

In a state in which the insertion part 167 is inserted into the second spring connection part 320, a projection 322 may be disposed on one of the insertion part 167 or an inner circumferential surface 321 of the second spring connection part 320 to prevent the cover protrusion 166 and the second spring connection part 320 from relatively rotating with respect to each other, and a projection accommodation groove 169 into which the projection 322 may be accommodated may be defined in the other one. For example, FIG. 13 illustrates a state in which the projection 322 is disposed on the inner circumferential surface 321 of the second spring connection part 320, and the projection accommodation groove 169 is defined in the insertion part 167.

The second support device 300 may further include a coupling member 330 that couples the second spring connection part 320 to the cover protrusion 166. The coupling member 330 may pass through the second spring connection part 320 and then be coupled to the insertion part 167.

The second spring connection part 320 may be integrally molded to the second plate spring 310 through the injection-molding process, or example. The second spring connection part 320 may be made of a rubber material, or example, to absorb vibration. Thus, the second spring connection part 320 may include first to third portions to prevent the second spring connection part 320 from being separated from the second plate spring 310 in the axial direction of the compressor body 100 in a state in which the second spring connection part 320 is insert-injection-molded to the second plate spring 310.

The second spring connection part 320 may include the first part 323 that extends from an outer circumferential surface of the third portion 325 passing through a hole defined in a center of the second plate spring 310 in the radial direction to come into contact with a first surface of the second plate spring 310 and the second portion 324 that extends from the outer circumferential surface of the third portion 325 in the radial direction to come into contact with a second surface of the second plate spring 310. The second surface may be defined as a surface opposite to the first surface.

The second plate spring 310 may include an outer rim 311, an 315, and a plurality of connection parts or portions 319 having a spirally rounded shape and connecting the outer rim 311 to the inner rim 315. More particularly, the plurality of connection parts 319 may be formed by a plurality of spiral holes defined inside of the metal plate having an approximately circular shape.

A hole through which the third portion 325 passes may be defined in center of the metal plate having the approximately circular shape. Also, a hole or slit extending in a spiral shape from an outer edge to an inner edge of the metal plate may be defined. A plurality of the hole or slit may be provided to form the second plate spring 310 having a predetermined elasticity.

That is, an outermost edge of the plurality of holes or slits extending in the spiral shape may be located at a point which is spaced a predetermined distance from the outer edge of the metal plate in a circumferential direction. Also, the innermost edge of the plurality of holes or slits may be located at a point which is spaced a predetermined distance from the inner edge of the metal plate in the circumferential direction. A boundary between the plurality of holes or slits may be defined as the connection part 319.

Thus, at least one communication hole 317 may be defined in a position of the second plate spring 310, which may be spaced apart from the space in which the second spring connection part 320 is disposed or provided, to prevent the second spring connection part 320 from rotating with respect to the second plate spring 310 in a state in which the second spring connection part 320 is insert-injection-molded to the second plate spring 310. For example, the space in which the second spring connection part 320 may be disposed or provided may be a space defined in an inner circumferential surface of the inner rim 315, and the at least one communication hole 317 may be defined in the inner rim 315.

When a plurality of communication holes 317 is defined in the inner rim 315, the plurality of communication holes 317 may be spaced apart from each other in a circumferential direction of the inner rim 315. The plurality of communication holes 317 may be spaced apart from an inner circumferential surface 316 of the inner rim 315 in the radial direction.

While the second spring connection part 320 is insert-injection-molded to the second plate spring 310, a gel-phase material forming the second spring connection part 320 may be filled into the plurality of communication holes 317. Thus, a portion corresponding to the resin solution disposed in the plurality of communication holes 317 after the second spring connection part 320 is insert-injection-molded to the second plate spring 310 may act as rotation resistance to prevent the second spring connection part 320 from rotating with respect to the second plate spring 310. The gel-phase material may include rubber or resin.

If the second plate spring 310 and the second spring connection part 320 relatively rotate with respect to each other in a state in which the second plate spring 310 is fixed to the compressor body 100 and the shell 101, the compressor body 100 may rotate around the axis while the compressor body 100 operates, and thus, the compressor body 100 may increase in vibration in the radial direction and/or the circumferential direction. However, according to this embodiment, as the relative rotation between the second plate spring 310 and the second spring connection part 320 is prevented, the vibration of the compressor body 100 in the radial direction and/or the circumferential direction while the compressor body 100 operates may be suppressed.

Also, the second plate spring 310 may further include a plurality of fixed parts or portions that extend from a outer circumferential surface of the outer rim 311 in the radial direction.

The second support device 300 may further include a washer 340 fixed to a front surface of the second spring connection part 320 by the coupling member 330. The washer 340 may include a coupling part or portion 342 closely attached to the front surface of the second spring connection part 320 and a bent part or portion 344 bent from an edge of the coupling part 342 to extend toward the second shell cover 103. The bent part 344 may have a cylindrical shape.

A stopper 400 may be disposed or provided at a center of a rear surface (or an inner surface) of the second shell cover 103. The stopper 400 may suppress the vibration of the compressor body 100 in the axial direction to minimize deformation of the second plate spring 310 and prevent the shell 101 from colliding by the vibration of the compressor body 100 in the radial direction.

The stopper 400 may include a fixed part or portion 402 fixed to the second shell cover 103 and a restriction part or portion 404 bent from the fixed part 402 to extend toward the second plate spring 310. For example, the restriction part 404 may have a cylindrical shape. The restriction part 404 may have an inner diameter greater than an outer diameter of the bent part 344 of the washer 340. Thus, the bent part 344 of the washer 340 may be accommodated in a region defined by the restriction part 404, and an outer circumferential surface of the bent part 344 of the washer 340 may be spaced apart from an inner circumferential surface of the restriction part 404 of the second stopper 400.

While the compressor body 100 operates, when the compressor body 100 vibrates in the radial direction, the outer circumferential surface of the bent part 344 of the washer 340 may come into contact with the inner circumferential surface of the restriction part 404 to restrict movement of the compressor body 100 in the radial direction thereby preventing the compressor body 100 from colliding with the shell 101. Also, in a state in which the operation of the compressor body 100 is stopped, the bent part 344 may be spaced apart from the fixed part 402. Thus, while the compressor body 100 operates, when the compressor body 100 vibrates in the axial direction, the bent part 344 of the washer 340 may come into contact with the fixed part 402 of the stopper 400 to restrict the movement of the compressor body 100 in the axial direction.

The support device 300 may include a buffer part or buffer 380 fitted into the fixed part 312 of the second plate spring 310, a washer 370 disposed or provided on a front surface of the buffer part 380, and a coupling bolt 360 (or a coupling member), that passes through the washer 370 and inserted into the buffer part 380.

Figure 15:
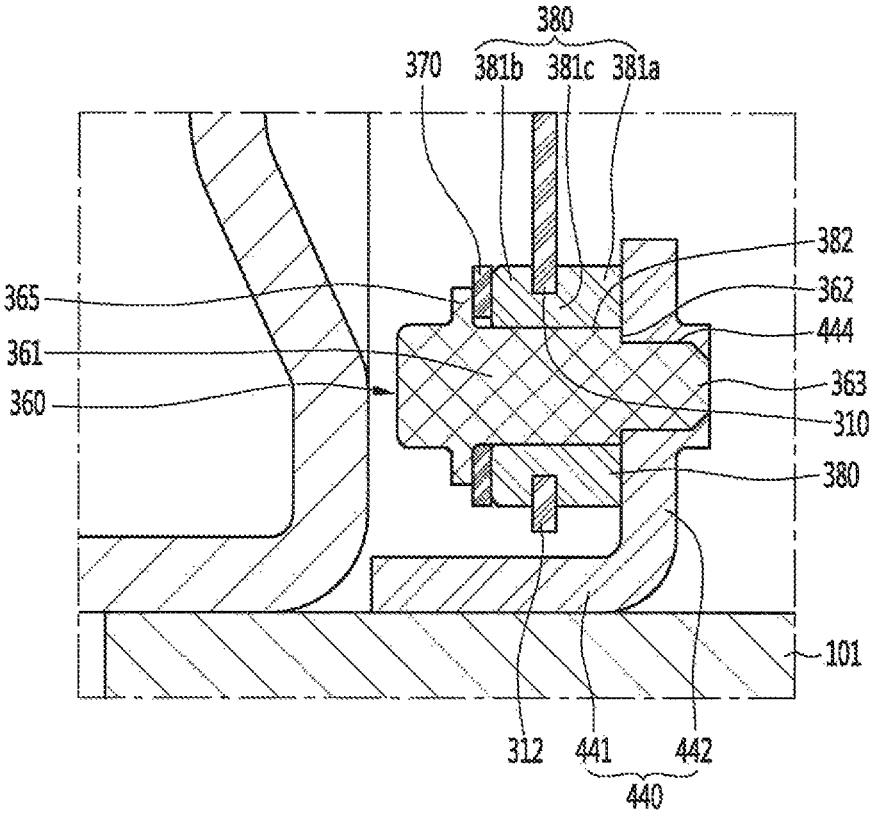
FIG. 15 is a cross-sectional view illustrating a state in which the second support device is fixed to the shell.

FIG. 15 is a cross-sectional view illustrating a state in which the second support device is fixed to the shell. Referring to FIG. 15 the shell 101 may be provided with a fixing bracket 440 that fixes the second support device 300.

The fixing bracket 440 may include a fixed surface 441 fixed to the shell 101 and a coupling surface bent from the fixed surface 441 to extend in the radial direction of the compressor body 100. A coupling hole 444 to which the coupling bolt 360 may be coupled may be defined in the coupling surface 442.

The buffer part 380 may be coupled to the second plate spring 318 to prevent the vibration of the compressor body 100 in the radial direction from being transmitted to the coupling bolt 380. The buffer part 380 may be integrated with the second plate spring 310 through the insert injection molding, for example. That is, the buffer part may be insert-injection-molded to the second plate spring 310 to form one body in such a manner in which the buffer part 380 is fitted into a hole defined in the fixed part 312. A through-hole 382 through which the coupling bolt 360 may pass may be defined in a center of the buffer part 380.

The buffer part 380 may include a first portion 381*a* that contacts the first surface of the fixed part 312 of the second plate spring 310, a second portion 381*b* that contacts the second surface which is a surface opposite to the first surface of the fixed part 312, and a third portion 381*c* that connects the first portion 381*a* to the second portion 381*b*. The coupling bolt 360 may include a body 361 having a cylindrical shape, a coupling part or portion 363 that extends from an end of the body 361 and coupled to the coupling surface 442, and a head 365 that protrudes from an outer circumferential surface of the body 361. The coupling part 363 may have a diameter less than a diameter of the body 361. Thus, the body 361 may include a stepped surface 362.

The first portion 381*a* of the buffer part 380 may contact the coupling surface 442. Thus, the second plate spring 310 may be spaced apart from the coupling surface 422 by the first portion 381*a* of the buffer part 380.

The coupling part 363 of the coupling bolt 360 may be coupled to the coupling surface 442 in a state of passing through the buffer part 380. Also, the stepped surface 362 of the body 361 may press the coupling surface 442. Thus the coupling part 363 may not be coupled to the buffer part 380 and the body may be maintained in a contact state with the buffer part 380.

According to this embodiment, when the vibration of the compressor body in the radial direction is transmitted to the buffer part 380, the vibration may be sufficiently absorbed by the buffer part 380 to prevent the vibration from being transmitted to the coupling bolt 360. The washer 370 may be interposed between the head 365 of the coupling bolt 360 and the buffer part 380. When the coupling part 363 is coupled to the coupling surface 442, the head 365 may press the washer 370. The washer 370 may press the buffer part 380 to the coupling surface 442. Thus, a pressed degree of the buffer part 380 may be secured by the pressing force applied from the head 365. When the pressed degree of the buffer part 380 is secured, the vibration of the buffer part 380 itself may be prevented.

Also, in a state in which the buffer part 380 comes into contact with the coupling surface 442, the fixed part 312 of the second plate spring 310 may be spaced apart from the coupling surface in the axial direction. Thus the vibration from the fixed part 312 of the second plate spring 310 may be prevented from being directly transmitted to the coupling surface 442.

According proposed embodiments disclosed herein, after the first support device connected to the end of the compressor body is coupled to the first shell cover, the shell may stand up to make the axis of the compressor body stand. In this state, as the other end of the compressor body and the second support device are coupled to each other to assemble the second support device to the inner circumferential surface of the shell, assembly convenience may be improved.

Further, as the first support device may be coupled to the first shell cover by using the buffer part as a medium a phenomenon in which vibration of the compressor body is transmitted to the shell may be minimized. Furthermore, as the second support device is fixed to the shell drooping of the compressor body may be prevented.

Also, when the first spring connection part is coupled to the first plate spring by the insert injection molding, as a portion of the first spring connection part is filled into the hole defined in the first plate spring relative rotation between the first spring connection part and the first plate spring may be prevented. Thus, while the compressor body operates, the vibration of the compressor body in the radial direction and/or the circumferential direction may be suppressed.

Additionally, when the second spring connection part is coupled to the second plate spring by the insert injection molding, as a portion of the second spring connection part is filled into the hole defined in the second plate spring, relative rotation between the second spring connection part and the second plate spring may be prevented. Thus, while the compressor body operates, the vibration of the compressor body in the radial direction and/or the circumferential direction may be suppressed.

Further, the buffer part may be coupled to the second plate spring, and the coupling bolt may be coupled to the fixing bracket in a state of passing through the buffer part. Therefore, vibration transmitted to the second plate spring may be absorbed by the buffer part, and thus, transmission of the vibration of the compressor body into the shell through the coupling bolt may be minimized.

Embodiments disclosed herein provide a linear compressor that may include a shell having both opened ends; a first shell cover that covers one or a first end of the shell; a second shell that covers the other or a second end of the shell; a compressor body accommodated in the shell to compress a refrigerant; a first support device or support that supports one end of the compressor body within the shell end coupled to the first shell cover in a state of being spaced apart from the shell; and a second support device or support that supports the other or a second end of the compressor body and fixed to the shell. The first support device may include a first plate spring, the second support device may include a second plate spring, and the compressor body may have an axis defined to pass through a center of the first plate spring and a center of the second plate spring.

The first support device may further include a first spring connection part or portion that extends from the center of the first plate spring, the first shell cover may include a cover coupling part or portion that couples the first spring connection part, and a buffer part or buffer may be disposed or provided between the first spring connection part and the cover coupling part. The buffer part may include a first contact surface coming into contact with or contacts an end of the first spring connection part; and a second contact surface extending from the first contact surface to come into contact with or contacts a circumferential surface of the first spring connection part.

A suction pipe may be connected to the first shell cover, an opening through which the refrigerant suctioned through the suction pipe may pass may be defined in the first contact surface, and a refrigerant passage through which the refrigerant passing through the opening may flow may be defined in the first spring connection part. Each of the cover coupling part, the buffer part, and the first spring coupling part may have a non-circular cross-section.

The first plate spring may include an outer rim connected to the compressor body; an inner rim integrally coupled to the first spring connection part, and a connection part or portion that connects the outer rim to the inner rim. One or a plurality of holes through which a portion of the first spring connection part may pass may be defined in the inner rim. The first spring connection part may include a first portion coming into contact with or contacts a first surface of the first plate spring; a second portion coming into contact with or contacts a second surface of the first plate spring, which is opposite to the first surface; and a third portion that passes through a center of the inner rim to connect the first portion to the second portion.

The linear compressor may further include a coupling member that couples the first plate spring to the compressor body in a state in which the first plate spring is spaced apart from the compressor body. The coupling member may include an insertion part or portion inserted into the compressor body; a contact part or contact having a diameter greater than a diameter of the insertion part and extending from an end of the insertion part to come into contact with or contact the compressor body; a spring insertion part or portion having a diameter less than a diameter of the contact part and extending from an end of the contact part to pass through the first plate spring. The second support device may further include a second spring connection part or portion that extends from the second plate spring, and the compressor body may include a cover protrusion coupled to the second spring connection part.

The linear compressor may further include an insertion part or portion that protrudes from a front surface of the cover protrusion and inserted into the second spring connection part. A projection may be disposed or provided on one of an outer circumferential surface or an inner circumferential surface of the second spring connection part, and a projection insertion groove into which the projection may be inserted may be defined in the other one to prevent the second spring connection part from relatively rotating with respect to the cover protrusion.

The second plate spring may include an inner rim to which the second spring connection part may be integrally coupled to a central portion thereof; an outer rim which may be spaced apart from the inner rim and from which a fixed part or portion to be fixed to the shell protrudes; and a connection part that connects the outer rim to the inner rim.

The second spring connection part may include a first portion coming into contact with or contacts a first surface of the second plate spring; a second portion coming into contact with or contacts a second surface of the second plate spring, which is opposite to the first surface; and a third portion that passes through a center of the inner rim to connect the first portion to the second portion. One or a plurality of holes through which a portion of the second spring connection part may pass may be defined in an edge of the inner rim.

The linear compressor may further include a buffer part or buffer fitted into a hole defined in the fixed part; a fixing bracket mounted on an inner circumferential surface of the shell; and a coupling member that passes through the buffer part and is inserted into the fixing bracket. The linear compressor may further include a washer interposed between a head portion or head of the coupling member and the buffer part.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also b apparent to those skilled in the art.

What is claimed is:

1. A linear compressor, comprising:

a shell having both first and second ends open;

a first shell cover that covers the first end of the shell;

a second shell cover that covers the second end of the shell;

a compressor body accommodated in the shell to compress a refrigerant;

a first support that supports a first end of the compressor body within the shell and coupled to the first shell cover in a state of being spaced apart from the shell; and a second support that supports a second end of the compressor body and fixed to the shell, wherein the first support includes:

a first plate spring; and a first spring connection portion that extends from a center of the first plate spring; a first buffer, wherein the first shell cover includes a cover coupling portion into which the first spring connection portion is inserted and the first buffer is fitted.

2. The linear compressor according to claim 1, wherein the second support includes a second plate spring, and wherein a central longitudinal axis of the compressor body passes through a center of the first plate spring and a center of the second plate spring.

3. The linear compressor according to claim 2, wherein the first buffer includes:

a first contact surface that contacts an end of the first spring connection portion; and a second contact surface that extends from the first contact surface to come into contact with an outer surface of the first spring connection portion.

4. The linear compressor according to claim 2, wherein each of the cover coupling portion, the first buffer, and the first spring connection portion has a non-circular cross-section.

5. The linear compressor according to claim 2, wherein the first plate spring includes:

an outer rim connected to the compressor body;

an inner rim integrally coupled to the first spring connection portion; and connecting portion that connects the outer rim to the inner rim, wherein one or a plurality of holes through which a portion of the first spring connection portion passes are defined in the inner rim, and the first spring connection portion includes:

a first portion that contacts a first surface of the first plate spring;

a second portion that contacts a second surface of the first plate spring, which is opposite to the first surface; and a third portion that passes through a center of the inner rim to connect the first portion to the second portion.

6. The linear compressor according to claim 2, further including a coupling member that couples the first plate spring to the compressor body in a state in which the first plate spring is spaced apart from the compressor body, wherein the coupling member includes:

an insertion portion inserted into the compressor body;

a contact having a diameter greater than a diameter of the insertion portion and extending from an end of the insertion portion to come into contact with the compressor body;

a spring insertion portion having a diameter less than the diameter of the contact and extending from an end of the contact to pass through the first plate spring.

7. The linear compressor according to claim 2, wherein the second support includes a second spring connection portion that extends from the second plate spring, and wherein the compressor body includes:

a cover protrusion coupled to the second spring connection portion; and an insertion portion that protrudes from a front surface of the cover protrusion and inserted into the second spring connection portion, wherein a projection is provided on one of an outer circumferential surface or an inner circumferential surface of the second spring connection portion, and a projection insertion groove into which the projection is inserted is defined in the other one of the outer circumferential surface or the inner circumferential surface of the second spring connection portion to prevent the second spring connection portion from relatively rotating with respect to the cover protrusion.

8. The linear compressor according to claim 7, wherein the second plate spring includes:

an inner rim to which the second spring connection portion is integrally coupled at a central portion thereof;

an outer rim which is spaced apart from the inner rim and from which a fixed portion to be fixed to the shell protrudes; and a connecting portion that connects the outer rim to the inner rim, and wherein the second spring connection portion includes:

a first portion that contacts a first surface of the second plate spring;

a second portion that contacts a second surface of the second plate spring, which is opposite to the first surface; and a third portion that passes through a center of the inner rim to connect the first portion to the second portion.

9. The linear compressor according to claim 8, wherein one or a plurality of holes through which a portion of the second spring connection portion passes are defined in an edge area of the inner rim.

10. The linear compressor according to claim 8, further including:

a fixing bracket mounted on an inner circumferential surface of the shell;

a second buffer fitted into a hole defined in the second plate spring; and a coupling member that passes through the second buffer and is inserted into the fixing bracket.

* * * * *